US008069898B1

(12) United States Patent
Mullet et al.

(10) Patent No.: US 8,069,898 B1
(45) Date of Patent: Dec. 6, 2011

(54) GUIDE APPARATUS AND METHOD

(75) Inventors: Willis Jay Mullet, Gulf Breeze, FL (US); Christopher Lee Wysoczynski, Gulf Breeze, FL (US); Richard Scott Hand, Pace, FL (US); Darrin W. Brunt, Pensacola, FL (US)

(73) Assignee: Homerun Holdings Corp., Pensacola, FL (US)

( * ) Notice: Subject to any disclaimer, the term of this patent is extended or adjusted under 35 U.S.C. 154(b) by 149 days.

(21) Appl. No.: 12/384,357

(22) Filed: Apr. 3, 2009

(51) Int. Cl.
*E04F 10/06* (2006.01)

(52) U.S. Cl. ..... 160/23.1; 160/19; 160/38; 160/405; 248/252; 248/266

(58) Field of Classification Search ..... 160/23.1, 160/19, 38, 405; 248/252, 266
See application file for complete search history.

(56) References Cited

U.S. PATENT DOCUMENTS

| | | | | |
|---|---|---|---|---|
| 4,089,075 | A | 5/1978 | May | |
| 4,102,007 | A | 7/1978 | Janson | |
| 4,114,233 | A | 9/1978 | Hamilton | |
| 4,401,146 | A | 8/1983 | von Knorring et al. | |
| 4,444,241 | A | 4/1984 | Amsler et al. | |
| 4,745,960 | A | 5/1988 | Karp | |
| 4,921,300 | A | 5/1990 | Lawassani et al. | |
| 5,156,196 | A | 10/1992 | Corey et al. | |
| 5,179,787 | A | 1/1993 | Ostrowski | |
| 5,284,199 | A * | 2/1994 | Finch et al. | 160/133 |
| 5,737,874 | A | 4/1998 | Sipos et al. | |
| 5,848,634 | A | 12/1998 | Will et al. | |
| 5,993,100 | A | 11/1999 | Gastmann | |
| 6,047,759 | A | 4/2000 | Lysyj | |
| 6,124,586 | A | 9/2000 | De Coi | |
| 6,283,427 | B1 * | 9/2001 | Møller et al. | 248/266 |
| 6,672,359 | B2 * | 1/2004 | Morris | 160/38 |
| 6,712,115 | B2 * | 3/2004 | Judkins | 160/32 |
| 6,755,231 | B1 | 6/2004 | Biggers | |
| 7,134,469 | B2 * | 11/2006 | Drew et al. | 160/38 |
| 7,506,679 | B2 | 3/2009 | Yu et al. | |
| 2009/0065156 | A1 | 3/2009 | Roberts et al. | |

OTHER PUBLICATIONS

The American Heritage® Dictionary of the English Language, Fourth Edition copyright © 2000 by Houghton Mifflin Company. Updated in 2009. Published by Houghton Mifflin Company. downloaded from http://www.thefreedictionary.com/curtain (definition printed in office action).*

* cited by examiner

*Primary Examiner* — Katherine Mitchell
*Assistant Examiner* — Johnnie A Shablack
(74) *Attorney, Agent, or Firm* — J. Nevin Shaffer, Jr.

(57) ABSTRACT

In a curtain assembly with a bracket, a guide apparatus includes a guide with a surface alignment tab and a bracket connector, for removable connection with a bracket, connected with the surface alignment tab. A first exit guide and a second exit guide locate a curtain within an opening front to back while the guide locates the curtain assembly within an opening side to side and front to back.

16 Claims, 6 Drawing Sheets

GUIDE APPARATUS AND METHOD

FIELD OF THE INVENTION

This invention relates to a guide apparatus and method in relation to a curtain assembly with a bracket. In particular, in accordance with one embodiment, the invention relates, in a curtain assembly with a bracket, to a guide apparatus including a surface alignment tab and a bracket connector, for removable connection with a bracket, connected with the surface alignment tab. A first exit guide and a second exit guide locate a curtain within an opening front to back while the guide locates the curtain assembly within an opening side to side and front to back.

BACKGROUND OF THE INVENTION

Accomplishing the task of installing a bracket for a curtain assembly such that the bracket is positioned so as to hold the curtain assembly precisely within an opening is fraught with difficulties. As any person who has attempted this task can tell you, multiple alignment issues present themselves. As used herein, the term "curtain assembly" is used broadly to describe an opening (such as a window for example only and not by limitation) cover system including a shade or curtain movably contained within a holding unit. The shade is wound and unwound on a shade roll within the unit, all as is known in the art. The curtain assembly itself includes a bracket that is typically a separate unit. The bracket is the critical element in the proper installation of a curtain assembly. Inaccurate location of the bracket results in the inaccurate location of the curtain assembly and misplacement of the shade within the opening.

With regard to the deployment of the curtain within the opening, it is a common problem of adjusting the location of the bracket such that the curtain is located a desired distance away from the glass in the opening, for example only. Thus it can be seen that side to side location is important but so also is front to back location.

Currently, there is no easy to use repeatable way to precisely locate a window covering curtain assembly. Unless you are a professional installer, this is a daunting task and the results are often disappointing and costly. Disappointing because the assembly may look right with the curtain up but any slight misalignment is revealed with the shade down. Costly because multiple attempts to locate and correct the location of the assembly causes damage to the opening often requiring professional help to repair.

Thus, there is a need in the art for a device and method for locating a curtain assembly in an opening that is easy to use, inexpensive compared to the cost of repairs and which does not add much to the overall cost of a curtain assembly, that is repeatable and which allows a user to adjust the location of a deployed curtain in multiple directions.

It, therefore, is an object of this invention to provide a guide apparatus and method that ensures accurate, repeatable, and reliable location of a curtain assembly within an opening both side to side and front to back. It is a further object of the invention that the system is easy to use, essentially "fool proof", and that does not add any significant cost to the basic cost of the curtain assembly.

SUMMARY OF THE INVENTION

Accordingly, the guide apparatus of the present invention, according to one embodiment includes, in a curtain assembly with a bracket, a guide includes a surface alignment tab and a bracket connector, for removable connection with a bracket, connected with the surface alignment tab.

According to other aspects of the invention, a gripping tab is provided. In one aspect the gripping tab includes a first gripping tab and a second gripping tab connected with the bracket connector. In another aspect, the first gripping tab is connected with the surface alignment tab and the bracket connector.

In one aspect, the bracket connector extends from the surface alignment tab and is conformed to be received within the bracket. In a further aspect, a first holding device is connected with the bracket. In one aspect, the first holding device is a double sided tape.

In another aspect, a guide stop is connected with the guide. In another aspect, the guide stop includes an outside stop surface for contact with the outside of the bracket. In one aspect the guide stop is connected with the guide apparatus between the surface alignment tab and the bracket connector.

In a further aspect, a first exit guide is connected with a curtain assembly and a second exit guide is connected with the curtain assembly. According to one aspect, the curtain assembly is a U-shaped assembly with two legs, front and back, and the first exit guide is connected within the curtain assembly at the front leg and the second exit guide is connected within the curtain assembly at the back leg. In another aspect, the first exit guide and the second exit guide include an extended curtain surface. In another aspect, the first exit guide and the second exit guide include an extended curtain surface with round edges.

According to another embodiment of the invention, in a curtain assembly with a bracket, a guide apparatus includes a first exit guide connected with a curtain assembly and a second exit guide connected with the curtain assembly such that a curtain connected with the curtain assembly is adjustable front to back in an opening by use of either the first exit guide or the second exit guide.

In another aspect, a guide is provided with a surface alignment tab and a bracket connector, for removable connection with a bracket, connected with the surface alignment tab. In one aspect, a guide stop is connected with the guide. In a further aspect, the curtain assembly is a U-shaped assembly with two legs, front and back, and the first exit guide is connected within the curtain assembly at the front leg and the second exit guide is connected within the curtain assembly at the back leg.

According to another embodiment, in a curtain assembly with a bracket, a guide method includes the steps of: providing a bracket and a guide with a surface alignment tab and a bracket connector, for removable connection with the bracket, connected with the surface alignment tab and a curtain assembly with a first exit guide connected with the curtain assembly and a second exit guide connected with the curtain assembly; connecting the bracket connector with the bracket and using the surface alignment tab to align the bracket with a surface; connecting the bracket with the surface after alignment; removing the guide; and connecting the curtain assembly with the bracket and where the curtain assembly includes a curtain positioned with the first exit guide or the second exit guide.

In another aspect, the curtain assembly is a U-shaped assembly with two legs, front and back, and the open end of the U is positioned facing down and the first exit guide is connected within the curtain assembly at the front leg and the second exit guide is connected within the curtain assembly at the back leg.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
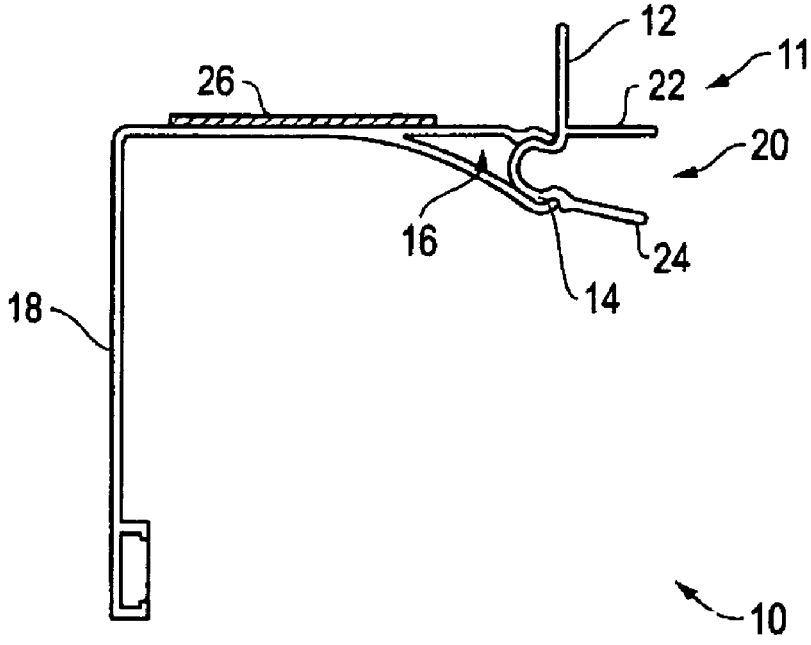
FIG. 1 is an end view of a bracket illustrating the surface alignment tab and bracket connector according to one embodiment of the present invention.

The preferred embodiment of the present invention is illustrated by way of example in FIGS. 1-7. With specific reference to FIG. 1, a guide apparatus 10 includes a guide 11 with a surface alignment tab 12 with a bracket connector 14. Bracket connector 14 extends from surface alignment tab 12 as illustrated and is conformed to be releasably retained with in bracket receiving channel 16 of bracket 18.

FIG. 1 also illustrates gripping tab 20. Preferably gripping tab 20 includes a first gripping tab 22 and, in this embodiment, a second gripping tab 24. Again, preferably, first gripping tab 22 and second gripping tab 24 are connected to bracket connector 14 in spaced apart relation as illustrated.

FIG. 1 also illustrates another aspect of the invention in the form of first holding device 26. First holding device 26 is preferably double sided tape connected with the bracket 18 on one side and, once properly located in an opening as will be described hereafter, with an opening on the other side. First holding device 26 is also preferably a removable tape such as 3M brand Christmas tape which can be used to temporarily secure an object to a surface and then be removed without leaving any sticky residue behind.

Figure 2A:
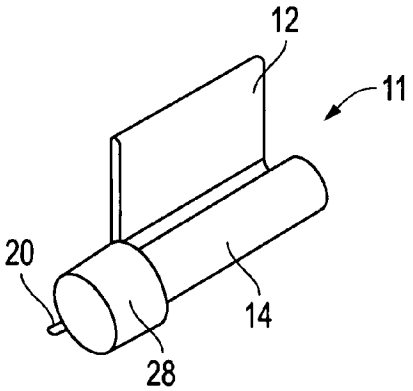
FIGS. 2A-E are a series of views, 2A front left side perspective, 2B front right side perspective, 2C end view, 2D top view and 2E front view, of the surface alignment tab and bracket connector according to one embodiment of the invention.
Figure 2B:
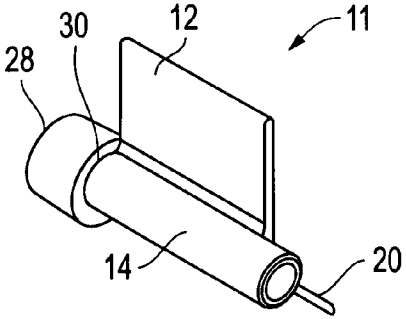
Figure 2C:
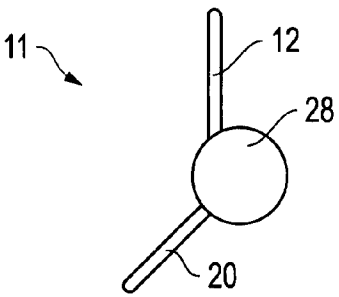
Figure 2D:
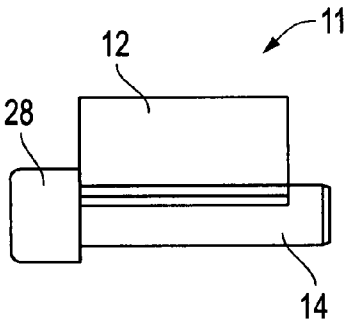
Figure 2E:
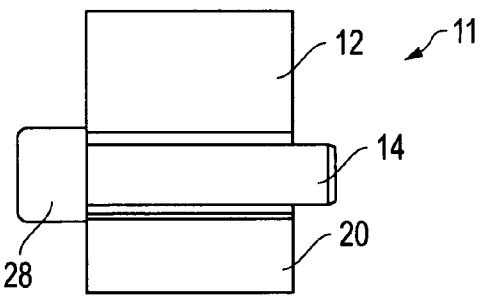

Referring now to FIGS. 2A-E another embodiment of the guide 11 is illustrated. FIG. 2A is front left perspective view of the guide 11 formed by a combination of surface alignment tab 12 and bracket connector 14 along with gripping tab 20. These elements are repeated in the other views for clarification showing them in a front right perspective view in FIG. 2B, an end view in FIG. 2C, a top view in FIG. 2D and a front view in FIG. 2E.

FIGS. 2A-E also illustrate another aspect of the invention in the form of stop 28. Preferably stop 28 is connected to the surface alignment tab 12 and the bracket connector 14 and at the end or edge of them as shown. Stop 28 includes an outside stop surface 30 (see especially FIG. 2B) for contact with bracket 18 as will be more fully described with regard to FIG. 3 hereafter. Altogether, FIGS. 2A-E illustrate the salient features and relative locations of the guide 11 including surface alignment tab 12, bracket connector 14, gripping tab 20 and stop 28. In combination, these elements are designed to enable guide 11 to be removably attachable with bracket 18 for the purpose of aligning bracket 18 within an opening as will be more fully described hereafter. Once aligned, however, bracket connector 14 that has been inserted into bracket receiving channel 16 is removed, thus removing all of guide 11, such that bracket receiving channel 16 is free to receive a curtain assembly, as will be more fully described with regard to FIGS. 4-7.

Figure 3:
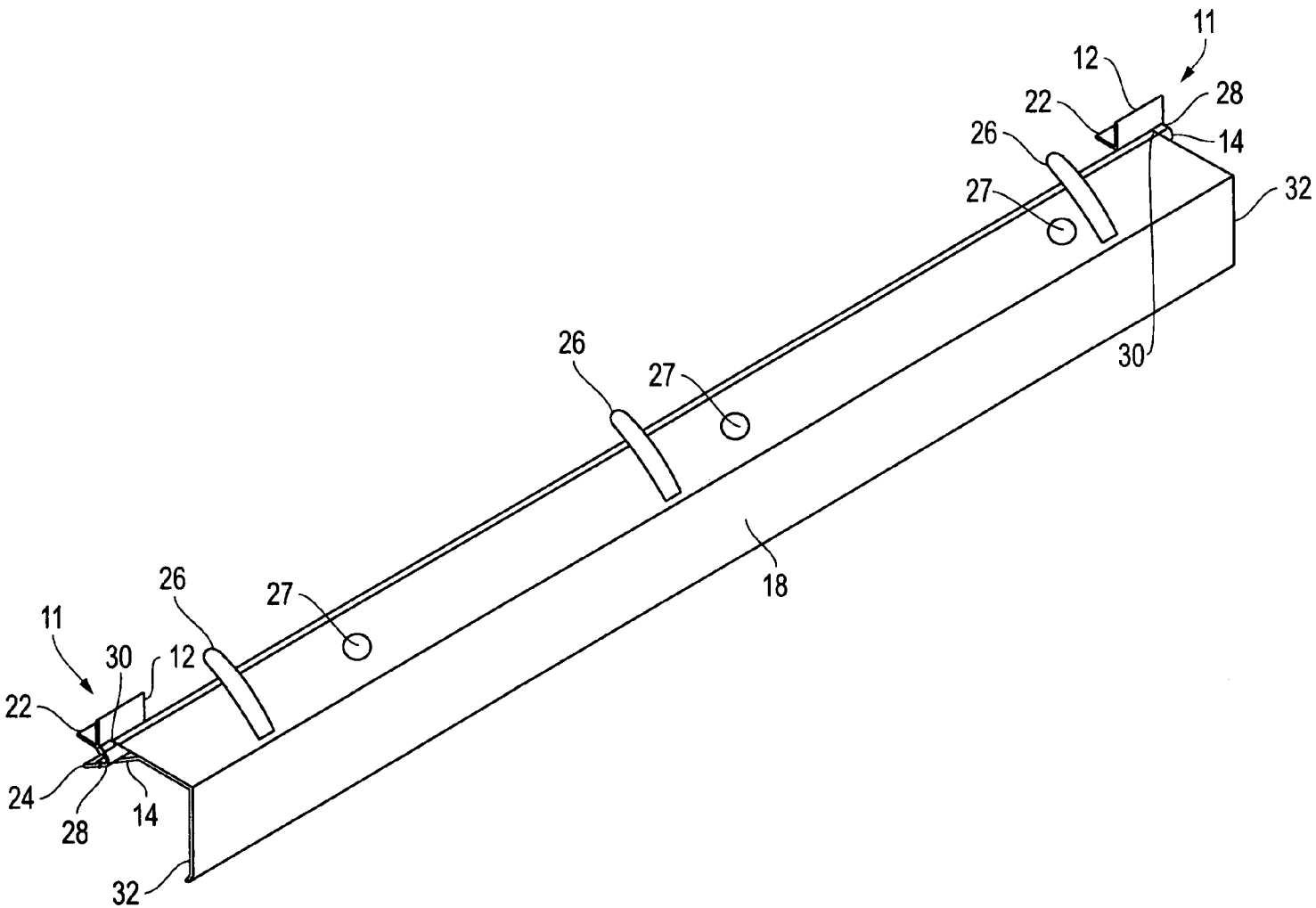
FIG. 3 is a rear perspective view of the bracket with the bracket connector connected with the bracket according to one embodiment of the invention.

Referring now to FIG. 3, a rear perspective view is shown in a preferred embodiment in which a pair of guides 11, as shown in FIG. 1, including bracket connectors 14, surface alignment tabs 12 and stops 28 are temporarily connected with bracket 18. Bracket 18 includes ends 32 and as illustrated it is made clear that preferably outside stop surface 30 of stop 28 abuts up against both ends 32 of bracket 18. The length of stop 28 may vary but preferably the length of each stop 28 is the same. Thus, outside stop surface 30 creates an overhanging space beyond the ends 32 that is equal. This allows a user to perfectly position bracket 18 within an opening such that it is equidistant from the sides of an opening as will be more fully described hereafter. Obviously, the guide 11 as fully illustrated in FIGS. 1A-E is suitable for this purpose as well.

FIG. 3 also shows first holding device 26 in the preferred form of a removable holding tape, such as 3M Christmas tape. First holding device 26 holds the bracket in place long enough for holes 27 in the bracket 18 to be used to insert a second holding device 48 (not shown) such as a screw, for example only. Once the second holding device 48 is partially installed, the first holding device 26 is removed. This prevents the first holding device 26 from creating an uneven surface and from leaving a residue that disfigures the structure surface when the bracket 18 is removed or replaced.

Figure 4:
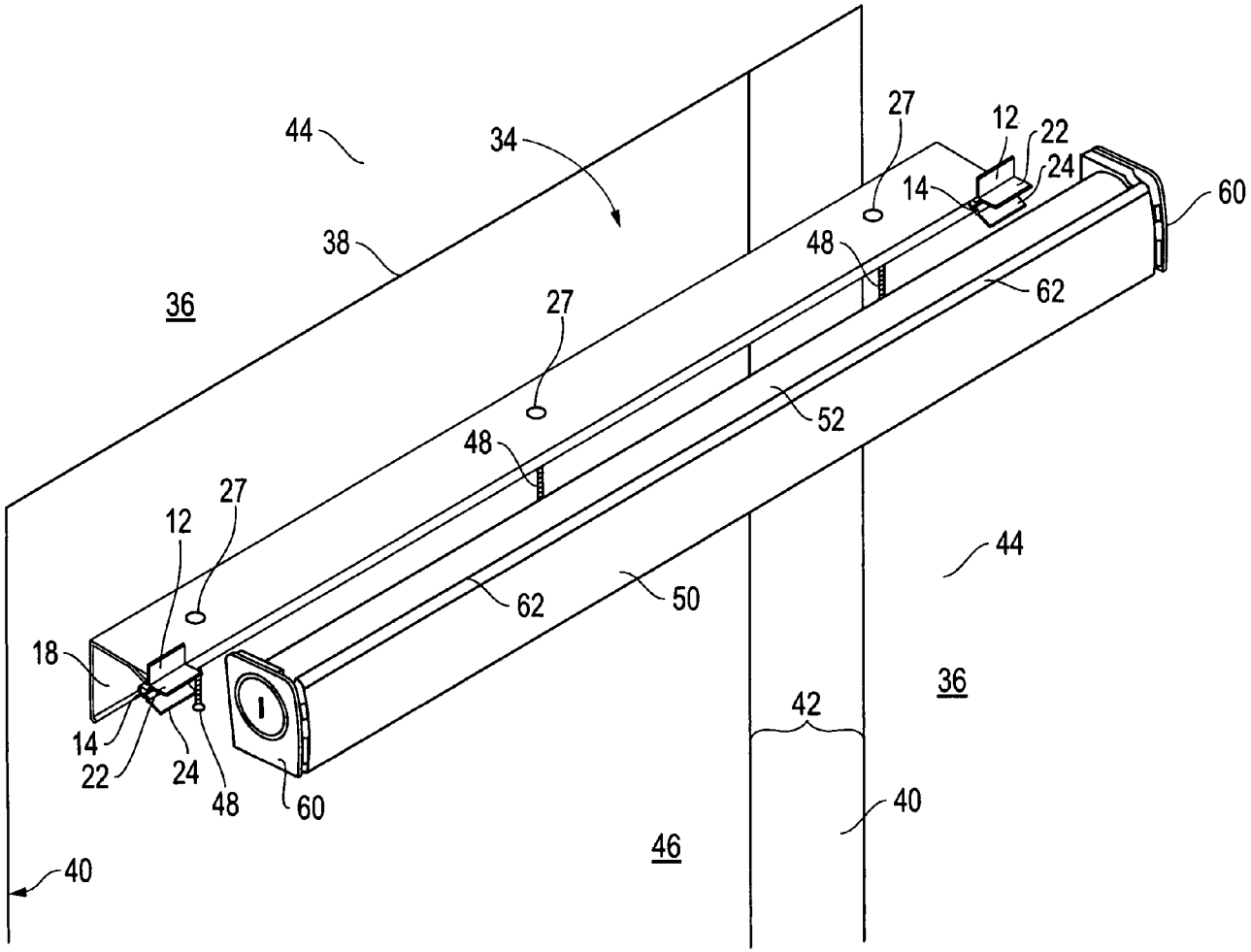
FIG. 4 is a front perspective view of a window opening, a bracket with bracket connector in place and a curtain assembly.

Referring now to FIG. 4, a more complete illustration of the invention is provided in reference to an opening 34. Opening 34 may be a window opening, a door opening or any similar opening. For reference, FIG. 4 shows opening 34 from the inside of a structure 36, such as the inside of a building for example only. Opening 34 thus includes a top 38 and sides 40 and a bottom (not shown). Sides 40 have a depth 42 from the surface 44 of structure 36 at least up to a window pane 46, for example only and not by way of limitation.

In use, bracket connector 14 is connected with bracket 18 as described above and bracket 18 is then positioned within opening 34. Surface alignment tabs 12 of guide 11 contact the surface 44 of structure 36 at the top 38 of opening 34. Bracket connectors 14 extend from the connection with bracket 18 the length of stops 28 (not shown) and, when placed in position within opening 34, bracket 18 is perfectly spaced apart from both sides 40 of opening 34. Likewise, surface alignment tabs 12 ensure that the bracket 18 is perfectly positioned front to back within opening 34. First holding device 26, double sided tape or removable tape, for example, is used to temporarily hold bracket 18 in this perfectly aligned position until second holding device 48, screw, nail bolt or the like, is installed for a more permanent attachment.

FIG. 4 also illustrates curtain assembly 50. Curtain assembly 50 contains curtain or shade 52 on a shade roll 54 (see FIGS. 5 and 6) as is known. Preferably, at least in combination with bracket 18, curtain assembly 50 is U-shaped with two legs, front leg 56 and back leg 58 (see FIGS. 5 and 6). End caps 60 cover the ends of curtain assembly 50 and support shade roll 54. In operation, again, once bracket 18 has been accurately located within opening 34, gripping tab 20 is used to remove bracket connector 14 which leaves bracket receiving channel 16 in bracket 18 free and open to receive curtain assembly lip 62. Just like bracket connector 14, curtain assembly lip 62 may be inserted and removed from bracket receiving channel 16 as desired. When in place, curtain assembly lip 62 holds curtain assembly 50 in connection with bracket 18.

Figure 5:
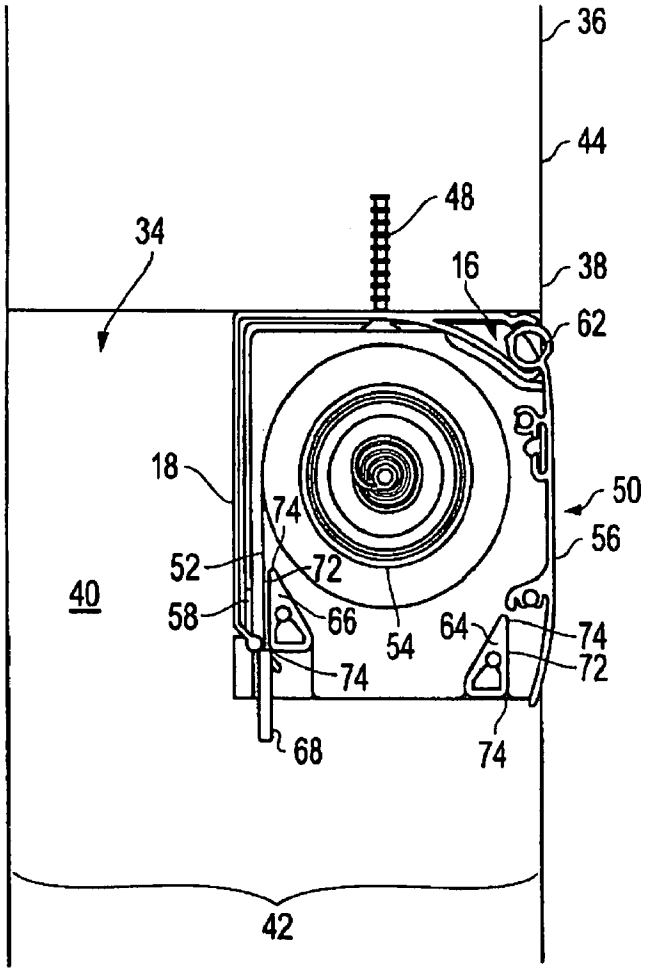
FIG. 5 is an end view of a bracket in place within a window opening with a curtain assembly attached to the bracket, the curtain assembly including a first exit guide and a second exit guide according to one embodiment of the invention and with the curtain located in the second exit guide.

Referring now to FIG. 5, curtain assembly 50 is shown with curtain assembly lip 62 connected with bracket receiving channel 16 within opening 34. In this view it is clear what is meant when curtain assembly 50 is described as "U-shaped" with front leg 56 and back leg 58 and the open end of the "U" facing down from the top 38 of opening 34.

Figure 6:
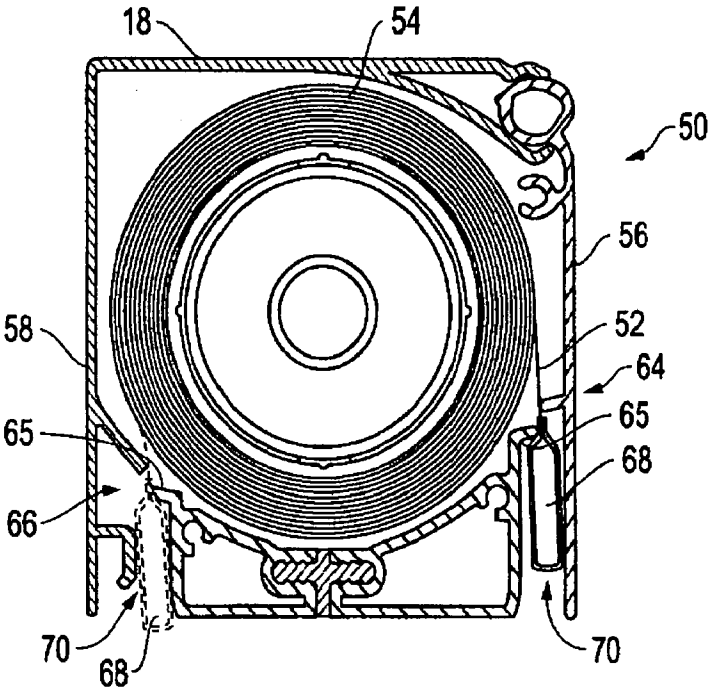
FIG. 6 is an end view of another embodiment of the exit guides with the curtain located in the first exit guide and a dotted line showing the location of the curtain in the second exit guide.

Importantly, FIG. 5 illustrates another important embodiment of the guide apparatus 10. First exit guide 64 and second exit guide 66 guide the position of shade 52 as it comes onto and off of shade roll 54. FIGS. 5 and 6 show first exit guide 64 connected next to front leg 56 and second exit guide 66 positioned next to back leg 58 of curtain assembly 50.

FIG. 5 shows shade 52 directed to the second exit guide 66 such that shade 52 is deployed next to back leg 58 of curtain assembly 50. This, therefore, allows the user to locate the shade 52 away from the surface 44 of structure 36 within the depth 42 of opening 34. This is an extraordinarily useful tool and an important improvement in the art. For the first time, a simple selection of the second exit guide 66 prior to connection of the curtain assembly 50 to the bracket 18 allows the user to adjust the shade 52 location within the opening 34 front to back along the depth 42 of opening 34. This allows the user to add curtains and other features in an unobtrusive manner and in locations that are now separated from the shade 52 and thus safe from interference with the shade 52, for example only.

FIG. 5 also shows a bottom bar 68 connected with shade 52. Bottom bar 68 adds weight to shade 52 and finishes off the end of shade 52 as is known. FIG. 5 also illustrates another aspect of first exit guide 64 and second exit guide 66 in the form of extended guide surface 72 with rounded edges 74. Extended guide surface 72 provides a flat surface upon which shade 52 moves. The flat extended surface ensures that the shade 52 deploys and retracts without wrinkles or bulges. Likewise the rounded edges 74 ensure that the shade is not cut or scrapped or injured during movement along the exit guides.

Referring to FIG. 6, and end view of another embodiment of exit guides 64 and 66 is provided. FIG. 6 shows shade 52 adjusted so as to exit curtain assembly 50 between first exit guide 64 and front leg 56. FIG. 6 shows that first exit guide 64 and front leg 56 combine to form a recess 70 within which bottom bar 68 is hidden when shade 52 is fully retracted onto shade roll 54. In this embodiment, first exit guide 64 includes a lip 65. There is no extended guide surface 72 as in FIG. 5. This simplifies construction cost and reduces weight where those are important.

FIG. 6 also shows second exit guide 66, lip 65 and recess 70 into which bottom bar 68 (shown in dotted lines) fits when shade 52 is fully retracted as shown.

Figure 7A:
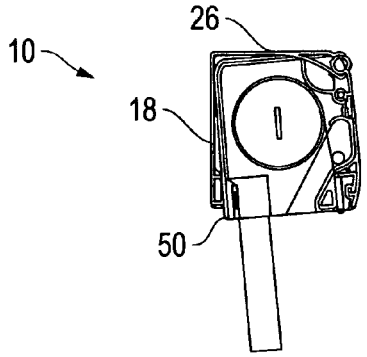
FIGS. 7A-E are a series of views illustrating the use of the invention according to one embodiment, 7A starting the process by removing the curtain assembly from the bracket, 7B connecting the bracket connector with the bracket, 7C locating the bracket within an opening, 7D securing the bracket in the opening, and 7E reconnecting the curtain assembly with the bracket with the curtain selectively located in the first exit guide.
Figure 7B:
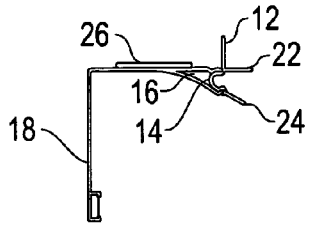
Figure 7C:
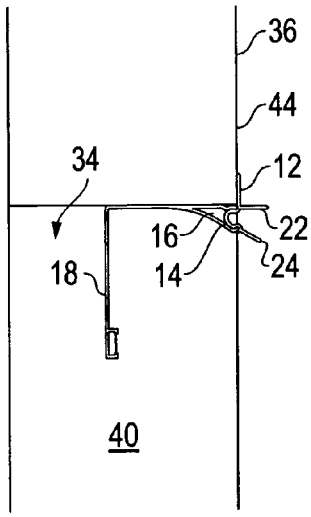
Figure 7D:
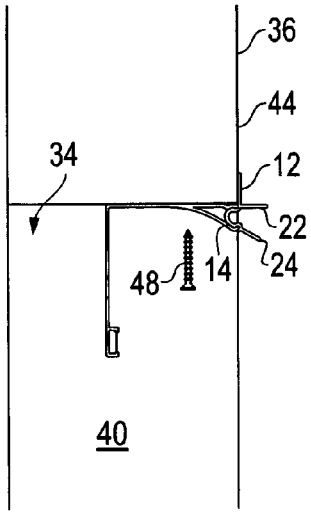
Figure 7E:
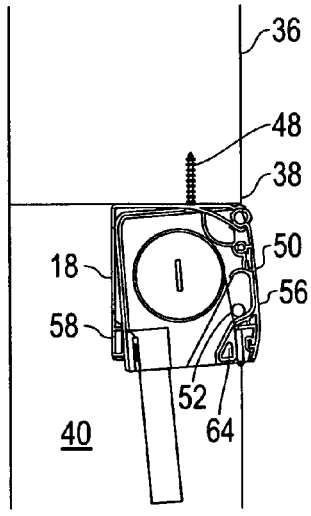

Referring now to FIGS. 7A-E, the steps for using guide apparatus 10 are illustrated beginning at FIG. 7A with removing curtain assembly 50 from bracket 18. It is assumed that these items will be connected for ease in packaging and shipping and so forth. FIG. 7B shows the next step of attaching guide 11, by means of bracket connector 14, to bracket receiving channel 16, in pairs as described above. Stop 28 ensures proper and equal spacing of bracket 18 within opening 34 side to side within opening 34 and surface alignment tab 12 ensures proper alignment of bracket 18 front to back within opening 34. First holding device 26 allows a user to then hold bracket 18 in place until second holding device 48 is used to secure the bracket 18 in the proper position as shown in FIGS. 7C and 7D. Preferably, before second holding device is completely secured, first holding device 26 is removed. Thereafter the user simply selects which exit guide, first exit guide 64 or second exit guide 66, to use with shade 52 for placement of the shade 52 front to back within opening 34. FIG. 7E shows that first exit guide 64 has been chosen. Thus, when the user connects curtain assembly 50 with bracket 18 the user is assured that the curtain assembly 50 is accurately positioned front to back and side to side within the opening 34 and so is the shade 52.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. In a curtain assembly with a bracket, a guide apparatus comprising:

a. a guide with a surface alignment tab conformed to align with a surface of a structure, said surface for supporting a curtain assembly with a bracket wherein said surface and said structure are separate from said curtain assembly and said bracket; and b. a bracket connector, for removable connection with said bracket, connected with said surface alignment tab.

2. The apparatus of claim 1 further including a gripping tab connected with said guide.

3. The apparatus of claim 1 wherein said bracket connector extends from said surface alignment tab and is conformed to be received within said bracket.

4. The apparatus of claim 2 wherein said gripping tab includes a first gripping tab and a second gripping tab connected with said bracket connector.

5. The apparatus of claim 4 wherein said first gripping tab is connected with said surface alignment tab and said bracket connector.

6. The apparatus of claim 1 further including a first holding means connected with said bracket.

7. The apparatus of claim 6 wherein said first holding means is a double sided tape.

8. The apparatus of claim 1 further including a guide stop connected with said guide.

9. The apparatus of claim 8 wherein said guide stop includes an outside stop surface for contact with an outside surface of said bracket.

10. The apparatus of claim 8 wherein said guide stop is connected with said guide between said surface alignment tab and said bracket connector.

11. The apparatus of claim 1 further including a first exit guide connected with a curtain assembly and a second exit guide connected with said curtain assembly.

12. The apparatus of claim 11 wherein said curtain assembly is a U-shaped assembly with two legs, front and back, and wherein said first exit guide is connected within said curtain assembly at said front leg and said second exit guide is connected within said curtain assembly at said back leg.

13. The apparatus of claim 11 wherein said first exit guide and said second exit guide include an extended curtain surface.

14. The apparatus of claim 11 wherein said first exit guide and said second exit guide include an extended curtain surface with round edges.

15. In a curtain assembly with a bracket, a guide method comprising:

a. providing a bracket and a guide with a surface alignment tab and a bracket connector, for removable connection with the bracket, connected with said surface alignment tab and a curtain assembly with a first exit guide connected with said curtain assembly and a second exit guide connected with said curtain assembly;

b. connecting the bracket connector with the bracket and using the surface alignment tab to align the bracket with a surface;

c. connecting the bracket with the surface after alignment;

d. removing the guide; and e. connecting the curtain assembly with the bracket wherein said curtain assembly includes a curtain positioned with said first exit guide or said second exit guide.

16. The method of claim 15 wherein said curtain assembly is a U-shaped assembly with two legs, front and back, and the open end of the U is positioned facing down and wherein said first exit guide is connected within said curtain assembly at said front leg and said second exit guide is connected within said curtain assembly at said back leg.

* * * * *